US010991488B2

(12) United States Patent
Ma et al.

(10) Patent No.: US 10,991,488 B2
(45) Date of Patent: Apr. 27, 2021

(54) SHED HOUSING

(71) Applicant: JIANGSU SHENMA ELECTRIC CO., LTD., Nantong (CN)

(72) Inventors: Bin Ma, Nantong (CN); Jiang Fang, Nantong (CN); Liquan Tang, Nantong (CN); Jianquan Jiang, Nantong (CN)

(73) Assignee: JIANGSU SHENMA ELECTRIC CO., LTD., Nantong (CN)

( * ) Notice: Subject to any disclaimer, the term of this patent is extended or adjusted under 35 U.S.C. 154(b) by 0 days.

(21) Appl. No.: 15/743,739

(22) PCT Filed: Dec. 5, 2017

(86) PCT No.: PCT/CN2017/114623

§ 371 (c)(1),
(2) Date: Jan. 11, 2018

(87) PCT Pub. No.: WO2019/041619

PCT Pub. Date: Mar. 7, 2019

(65) Prior Publication Data

US 2019/0066885 A1 Feb. 28, 2019

(30) Foreign Application Priority Data

Aug. 31, 2017 (CN) ..... 201710768110.6

(51) Int. Cl.
*H01B 17/50* (2006.01)
*H01B 17/38* (2006.01)
*H01B 17/52* (2006.01)

(52) U.S. Cl.
CPC ..... *H01B 17/50* (2013.01); *H01B 17/38* (2013.01); *H01B 17/52* (2013.01)

(58) Field of Classification Search
CPC ..... H01B 17/50; H01B 17/38; H01B 17/52
(Continued)

(56) References Cited

U.S. PATENT DOCUMENTS 1,772,947 A * 8/1930 Hoffmann ..... H01B 17/46 174/141 R
1,880,259 A * 10/1932 Knapp ..... H01B 17/005 174/141 R
(Continued)

FOREIGN PATENT DOCUMENTS

CN 2067452 U 12/1990
CN 103545062 A 1/2014
(Continued)

OTHER PUBLICATIONS

First Office Action for Canadian Counterpart Patent Application No. 2991998, dated Nov. 16, 2018, (5 pages).
(Continued)

*Primary Examiner* — William H. Mayo, III
*Assistant Examiner* — Krystal Robinson
(74) *Attorney, Agent, or Firm* — Kagan Binder, PLLC

(57) ABSTRACT

A shed housing is disclosed. The shed housing covers an insulator including at least one shed. The shed housing includes a receiving cavity allowing an upper surface and a lower surface of the shed to be received in the receiving cavity. The shed housing is provided with a mounting hole through which the insulator passes, and an opening corresponding to the mounting hole. The opening communicates the mounting hole with an outer edge of the shed housing. The mounting hole communicates with the receiving cavity. A first connecting portion and a second connecting portion cooperating with the first connecting portion are arranged respectively on both ends of the opening. When the first connecting portion is connected to the second connecting portion, the shed housing is closed along a circumferential direction. The shed housing is able to receive the entire piece of shed, and can be assembled on the shed without any additional connecting components, which is convenient and
(Continued)

high-efficient and has good effect on preventing pollution flashover and rain flashover.

7 Claims, 12 Drawing Sheets

(58) Field of Classification Search
USPC ..... 174/137 R
See application file for complete search history.

(56) References Cited

U.S. PATENT DOCUMENTS 1,940,591 A * 12/1933 Hawley ..... H01B 17/46
174/141 R
2,099,540 A * 11/1937 Smith ..... H01B 17/00
174/139
4,053,707 A * 10/1977 Ely ..... H01B 17/42
174/209
4,833,278 A * 5/1989 Lambeth ..... H01B 17/525
174/139
5,023,406 A * 6/1991 Thornley ..... H01B 17/42
174/209
5,446,242 A * 8/1995 Barrett ..... H01B 17/14
174/137 R
5,637,831 A * 6/1997 Lambeth ..... H01B 17/42
174/209
6,303,870 B1 * 10/2001 Nazaryan ..... H01B 17/00
174/155

FOREIGN PATENT DOCUMENTS

| | | | | |
|---|---|---|---|---|
| CN | 104538130 | A | | 4/2015 |
| CN | 104538131 | A | * | 4/2015 |
| CN | 104538131 | A | | 4/2015 |
| CN | 104538130 | B | | 10/2016 |
| JP | 2012196040 | A | | 10/2012 |
| JP | 2012248422 | A | | 12/2012 |

OTHER PUBLICATIONS

International Search Report for PCT Application No. PCT/CN2017/114623, and English translation thereof (13 pages).
First Office Action for European Counterpart Patent Application No. 17817643.4, dated Feb. 11, 2020, (9 pages).

* cited by examiner

SHED HOUSING

FIELD

The present disclosure relates to the field of insulation device for power transmission, and more particularly, to a shed housing.

BACKGROUND

At present, insulators have been widely used in the electric power industry. Early insulators are usually porcelain insulators. However, with the deterioration of the atmospheric environment, air pollution levels are getting higher and higher. Because of the pollution accumulation, porcelain insulators may have pollution flashover accidents continuously, causing tremendous losses to the power grid and affecting the smooth operation of the power grid seriously. Moreover, due to heavy rain, icing and other issues, the porcelain insulators may also have rain flashover, ice flashover and other accidents continually.

To address the above problem, a conventional solution generally includes a method of spraying RTV/PRTV coating on the surface of the porcelain insulator. However such method is not only costly, but also has a limited service life, so it cannot guarantee a long-term operation fundamentally. In the prior art, a single piece of shed housing made of a composite material is used to cover the upper surface of the porcelain insulator to address the above problem. However, the connection between the single piece of shed housing and the porcelain insulator is poor, an edge of the shed is prone to collapse, and there is little effect on preventing pollution flashover and rain flashover.

SUMMARY

In view of the deficiencies in the prior art, one of objectives of the present disclosure is to provide an shed housing which is able to receive the entire piece of shed and be assembled on the shed without any additional connecting components, and which is convenient and high-efficient and has good effect on preventing pollution flashover and rain flashover.

In order to achieve the above objective, a shed housing is provided herein. The shed housing can cover an insulator including at least one shed. The shed housing includes a receiving cavity to allow an upper surface and a lower surface of the shed to be received in the receiving cavity. The shed housing is provided with a mounting hole through which the insulator passes, and an opening corresponding to the mounting hole. The opening can communicate the mounting hole with an outer edge of the shed housing. The mounting hole can communicate with the receiving cavity. A first connecting portion and a second connecting portion cooperating with the first connecting portion can be arranged respectively on both ends of the opening. When the first connecting portion is connected to the second connecting portion, the shed housing can be closed along a circumferential direction.

The above shed housing can receive the entire shed in the shed housing by using the receiving cavity, so the area of the connection between the shed housing and the shed can be increased, to provide a more reliable and robust connection. In addition, the closure of the shed housing along the circumferential direction can be achieved by joining the first connecting portion and the second connecting portion of the shed housing arranged on the shed together directly, without any additional connecting components. In this way, the installation can be convenient and efficient, and the cost can be saved, since there is no need to make a model for producing the connecting components.

Preferably, the above shed housing is divided into an upper shed housing body and a lower shed housing body by a tip of the shed received in the receiving cavity. A first groove is provided on a portion of the first connecting portion located on the upper shed housing body, and a first strap corresponding to the first groove is provided on a portion of the second connecting portion located on the upper shed housing body.

Preferably, a second groove is provided on a portion of the first connecting portion located on the lower shed housing body, and a second strap corresponding to the second groove is provided on a portion of the second connecting portion located on the lower shed housing body.

The first connecting portion can be connected to the second connecting portion by the configurations of the groove and the strap, with a large contact area, to ensure reliability of the connection.

When the first groove is connected to the first strap, an upper surface of the second connecting portion is flush with the surface of the upper shed housing body. When the second groove is connected to the second strap, a lower surface of the second connecting portion is flush with the surface of the lower shed housing body.

The connecting surfaces formed by connection between the first connecting portion and the second connecting portion can be respectively flush with the upper surface and the lower surface of the shed housing, so that the shed housing has continuous upper and lower surfaces to improve the effect on preventing pollution flashover and rain flashover.

Preferably, the first connecting portion is connected to the second connecting portion through a locking structure.

Preferably, the locking structure includes a protrusion and a through hole arranged on the first connecting portion and the second connecting portion, and the protrusion and the through hole have diameters such that the protrusion fits the through hole tightly.

The above locking structure can be achieved by fitting between the protrusion and the through hole. Further, the protrusion can have a height slightly longer than the through hole, so that the connection can be more reliable and tighter.

Preferably, the portion of the first connecting portion located on the upper shed housing body is provided with at least one first protrusion, and the portion of the second connecting portion located on the upper shed housing body is provided with at least one first through hole fitting the first protrusion.

Preferably, the portion of the first connecting portion located on the lower shed housing body is provided with at least one second protrusion, and the portion of the second connecting portion located on the lower shed housing body is provided with at least one second through hole fitting the second protrusion.

The amount and arrangement of the above protrusion and through hole on the first connecting portion and the second connecting portion can be designed according to the actual size of the shed housing, which is flexible and convenient.

Preferably, the shed housing includes an extended portion extending outward from a tip of the shed, and the first connecting portion and the second connecting portion extend along an upper surface of the extended portion.

The above extended portion can effectively increase the creepage distance, to further improve the effect of the shed housing on preventing pollution flashover and rain flashover.

Preferably, the insulator comprises an insulating core, and a distance from an edge of the mounting hole to a tip of the shed along a surface of the shed is smaller than a distance from the tip of the shed to a junction between the insulating core and the surface of the shed along the surface of the shed.

The distance from the edge of the mounting hole to the tip of the shed along the surface of the shed is smaller than the distance from the tip of the shed to the junction between the insulating core and the surface of the shed along the surface of the shed, that is, the receiving cavity can completely cover the upper surface and the lower surface of the shed, or the receiving cavity can also partially cover the upper surface and the lower surface of the shed, so that the effect on preventing pollution flashover and rain flashover can be achieved, meanwhile, the cost can be saved and the shed housing can be sleeved on the insulating core conveniently.

Preferably, the receiving cavity is formed by joining the upper shed housing body and the lower shed housing body, and the upper shed housing body with the lower shed housing body are provided separately.

Since the upper shed housing body and the lower shed housing body are provided separately, the shed housing can be assembled more conveniently. Further the whole shed housing can be divided into two relatively independent parts, to simplify the configuration and facilitate making models for production.

Preferably, the insulator includes an insulating core, a sleeve is provided on the shed housing at the mounting hole, the sleeve extends outward and away from a surface of the shed along an axial direction of the insulating core, and the sleeve is sleeved on the insulating core.

The sleeve can extend outward and away from a surface of the shed along an axial direction of the insulating core and cover the insulating core, so that the reliability of the connection between the shed housing and the insulator can be further improved.

DETAILED EMBODIMENTS

Figure 1:
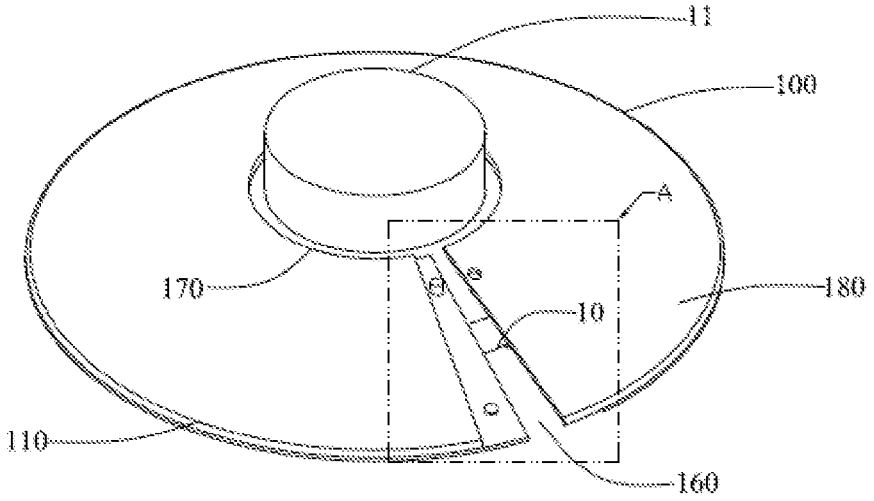
FIG. 1 is a perspective diagram illustrating a shed housing 100 with an unclosed opening mounted on a shed 10 according to Embodiment One of the present disclosure.
Figure 2:
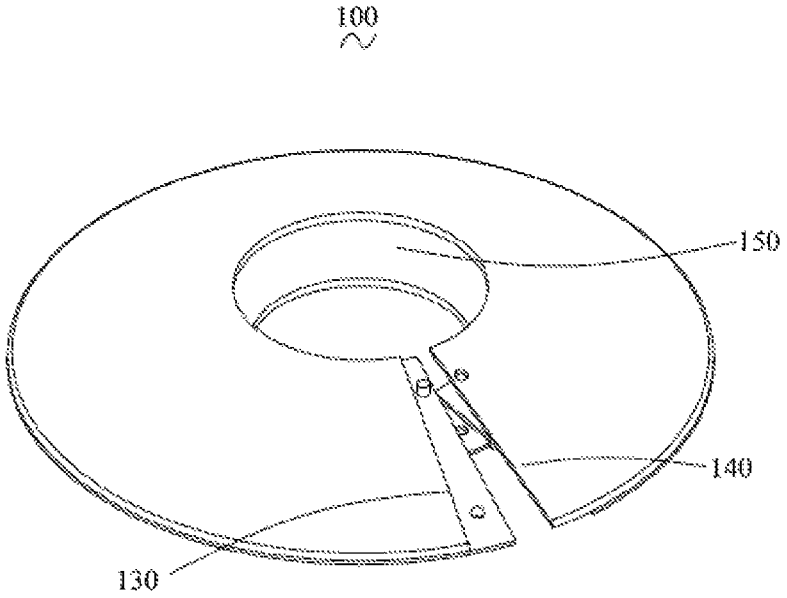
FIG. 2 is a perspective diagram illustrating the shed housing 100 according to Embodiment One of the present disclosure.
Figure 3:
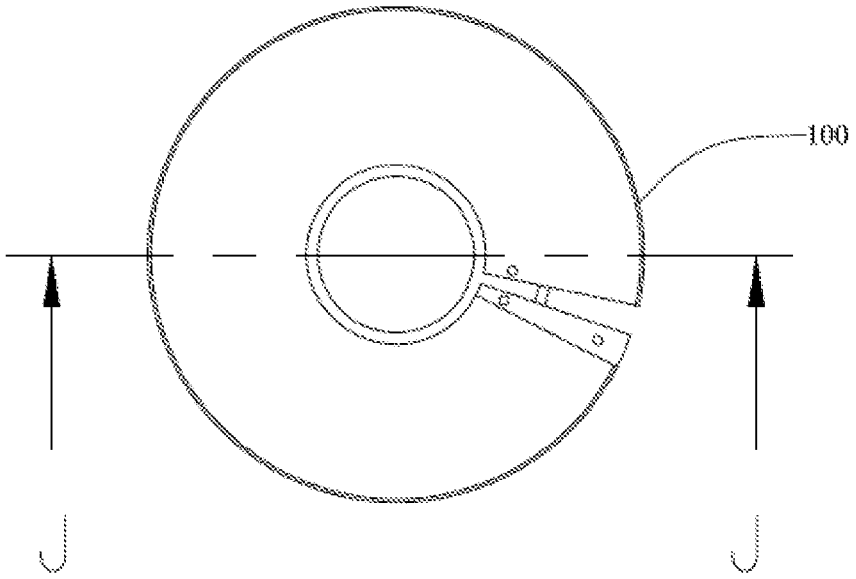
FIG. 3 is a top view of the shed housing 100 with the unclosed opening mounted on the shed 10 according to Embodiment One of the present disclosure.
Figure 4:
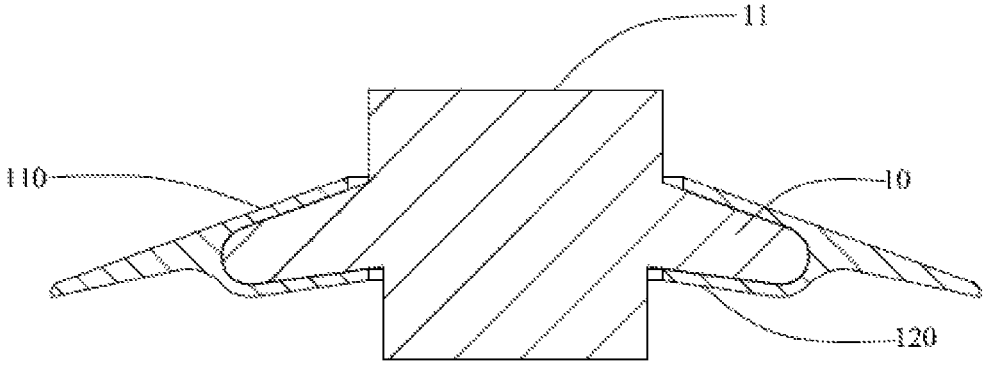
FIG. 4 is a schematic diagram illustrating a cross section of the shed housing 100 with the unclosed opening mounted on the shed 10 along a J-J plane according to Embodiment One of the present disclosure.

As required, detailed embodiments of the present disclosure are disclosed herein. However, it is to be understood that the disclosed embodiments are merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure in virtually any appropriate manner, including employing various features disclosed herein in combinations that might not be explicitly disclosed herein.

Embodiment One

As shown in FIGS. 1 to 4, an insulator includes an insulating core 11, and further includes a shed 10 extending outward from an outer surface of the insulating core 11 in a direction perpendicular to the insulating core 11. The insulator may include at least one shed 10 and a shed housing 100 may cover an outer surface of the shed 10. The shed housing 100 is divided into an upper shed housing body 110 and a lower shed housing body 120 by a tip of the shed 10. Both the upper shed housing body 110 and the lower shed housing body 120 are conical-shaped and together form a receiving cavity 150. Both an upper surface and a lower surface of the shed 10 may be received in the receiving cavity 150. The shed housing 100 is provided with a mounting hole 170.

The shed housing 100 is provided with an opening 160 corresponding to the mounting hole 170. The opening 160 communicates with the mounting hole 170 and an outer edge of the shed housing 100, so that the shed housing 100 may be mounted on the insulator by opening and closing of the opening 160. The receiving cavity 150, the opening 160 and the mounting hole 170 communicate with each other. Both ends of the opening 160 are provided with a first connecting portion 130 and a second connecting portion 140 respectively. The first connecting portion 130 and the second connecting portion 140 may cooperate with and be connected with each other. When the first connecting portion 130 is connected to the second connecting portion 140, the shed housing 100 is closed along a circumferential direction.

The upper shed housing body 110 extends outward from the tip of the shed 10 to form an extended portion 180. Both the first connection portion 130 and the second connection portion 140 extend along an upper surface of the extended portion 180, and the mounting hole 170 communicates with an outer edge of the extended portion 180. Alternatively, the extension portion 180 may also be formed by extending the lower shed housing body 120 outwardly, or may be provided separately.

Figure 5:
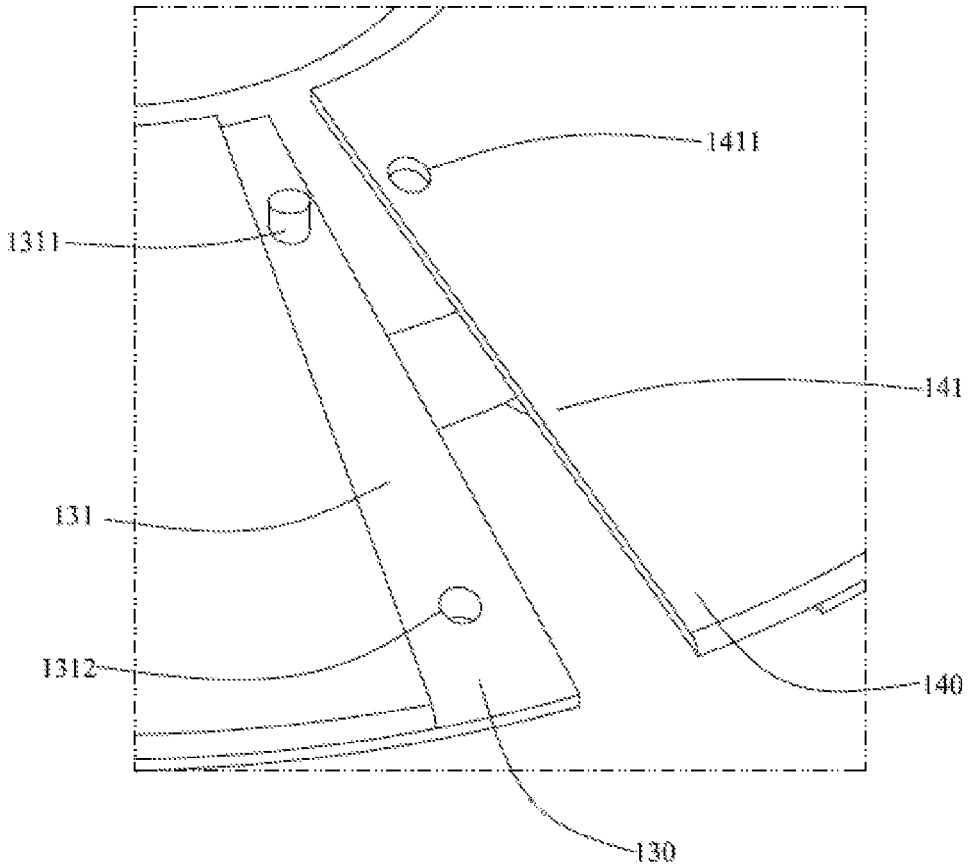
FIG. 5 is an enlarged view of a portion A of the shed housing 100 with the unclosed opening mounted on the shed 10 according to Embodiment One of the present disclosure.

As shown in FIG. 5, which is an enlarged view of a portion A of the shed housing 100, a groove 131 is provided on a portion of the first connecting portion 130 located on the upper shed housing body 110, and the groove 131 is step-shaped. A strap 141 is provided on a portion of the second connecting portion 140 located on the upper shed housing body 110, and the strap 141 is formed by extending a surface of the upper shed housing body 110 around the center of the insulating core 11. The groove 131 may cooperate with the strap 141. When the groove 131 fits and is connected to the strap 141, the shed housing 100 is closed along a circumferential direction. The connection portion has a same thickness as the shed housing 100, so the surface of the upper shed housing body may have smooth transition at a joining of the opening 160.

Figure 6:
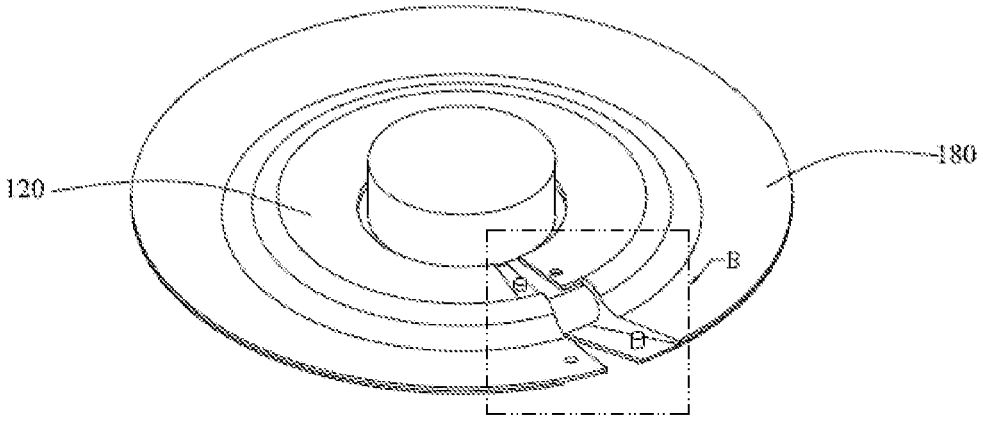
FIG. 6 is a bottom view of the shed housing 100 with the unclosed opening mounted on the shed 10 according to Embodiment One of the present disclosure.

As shown in FIG. 5 and FIG. 6, a groove 132 is provided on a portion of the first connecting portion 130 located on the lower shed housing body 120, and the groove 132 is step-shaped. A strap 142 is provided on a portion of the second connecting portion 140 located on the lower shed housing body 120, and the strap 142 is formed by extending the lower shed housing body 120 around the center of the insulating core 11. The groove 132 may fit the strap 142. When the groove 132 fits and is connected to the strap 142, the shed housing 100 is closed along a circumferential direction. The connection portion has a same thickness as the shed housing 100, so the surface of the lower shed housing body 120 may have smooth transition at a joining of the opening 160.

Figure 7:
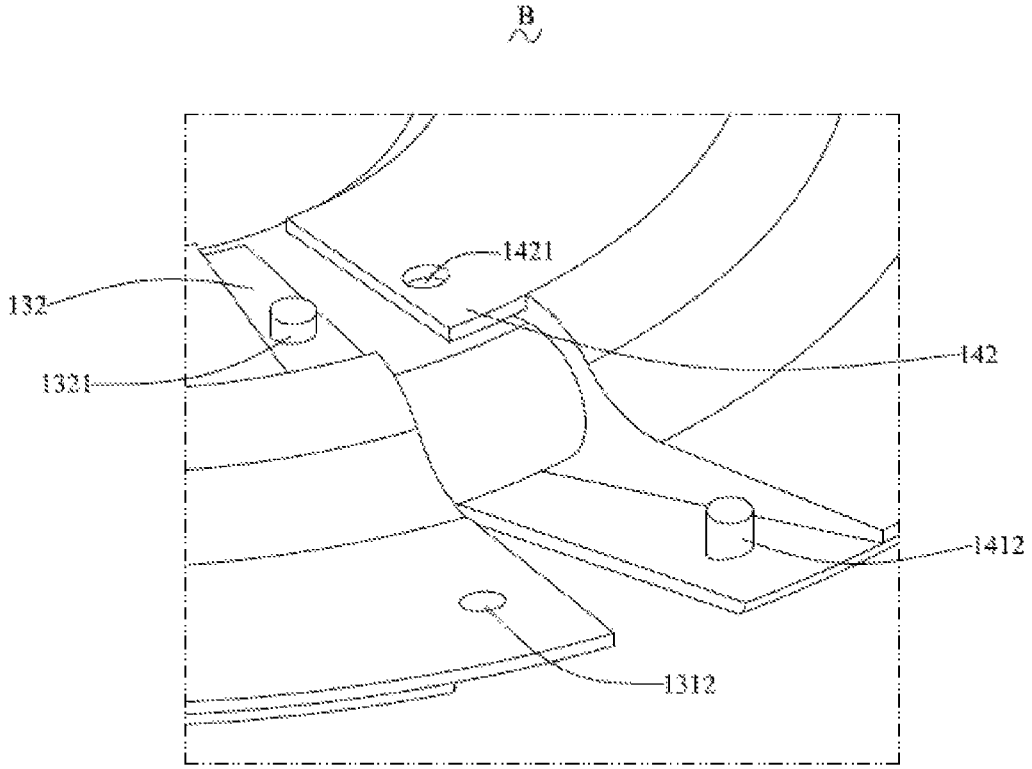
FIG. 7 is an enlarged view of a portion B of the shed housing 100 according to Embodiment One of the present disclosure.

As shown in FIG. 5 and FIG. 7, the first connecting portion 130 and the second connecting portion 140 are connected by a locking structure. Specifically, the locking structure includes a protrusion and a through-hole cooperating with the protrusion. When the protrusion cooperates with and is connected to the through hole, the protrusion extends out of the through holes slightly. A protrusion 1311 and a through hole 1312 are provided on the groove 131 of the first connecting portion 130 located on the upper shed housing body 110, and the protrusion 1311 and the through hole 1312 are distributed at both ends of the groove 131 along a radial direction of the shed housing 100. The protrusion 1311 is arranged near the connecting hole 170, the through hole 1312 is arranged near the outer edge of the shed housing 100, and centers of the protrusion 1311 and the through hole 1312 are located on a same radial line. A through hole 1411 and a protrusion 1412 are provided on the strap 141 of the second connecting portion 140 located on the upper shed housing body 110. The through hole 1411 is positioned to correspond to the position of the protrusion 1311, and the protrusion 1412 is positioned to correspond to the position of the through hole 1312. The through hole 1312 is arranged on a lower surface of the strap 141, and extends downward along the insulating core 11. The protrusion 1311 and the through hole 1411 have diameters such that the protrusion 1311 fits the through hole 1411 tightly, and the protrusion 1312 and the through hole 1412 have diameters such that the protrusion 1312 fits the through hole 1412 tightly, that is, the through hole 1411 may be sleeved on the protrusion 1311, and the through hole 1312 may be sleeved on the protrusion 1412, so that the groove 131 is connected to the strap 141.

A protrusion 1321 is provided in the groove 132 of the first connecting portion 130 located on the lower shed housing body 120, and a through hole 1421 is provided in the strap 142 of the second connecting portion 140 located on the lower shed housing body 120 and at a position corresponding to the position of the protrusion 1321. The protrusion 1321 and the through hole 1421 have diameters such that the protrusion 1321 fits the through hole 1421 tightly, that is, the through hole 1421 may be sleeved on the protrusion 1321, so that the groove 132 is connected to the strap 142.

In this embodiment, the first connecting portion 130 has the protrusion 1311 and the through hole 1312 provided on the upper shed housing body 110, and the protrusion 1321 provided on the lower shed housing body 120, and the second connecting portion 140 has the through hole 1411 and the protrusion 1412 provided on the upper shed housing body 110, and the through hole 1421 provided on the lower shed housing body 120. Alternatively, all the protrusions may be provided on the first connecting portion 130, and all the through holes corresponding to the protrusions may be provided on the second connecting portion 140. The amount of pairs of the protrusion and the through hole may not be limited to three as mentioned above, that is, the amount and the size of the protrusions and the through holes on the first connecting portion 130 and the second connecting portion 140 can be adjusted according to the actual size of the shed housing. The above protrusions have a same size and each is a cylindrical protrusion. Of course, the shape of each protrusion may not be limited to the cylindrical shape, or the protrusion 1311, the protrusion 1321 and the protrusion 1412 may have different shapes from each other.

Figure 8:
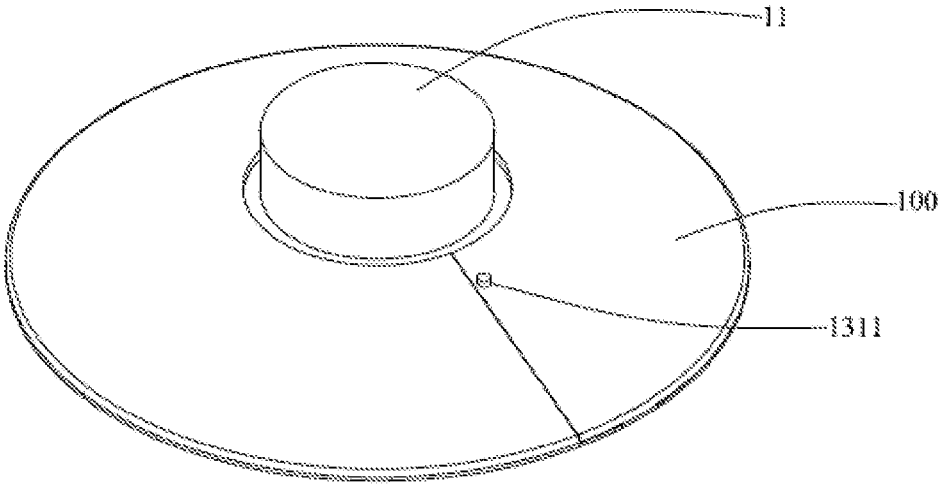
FIG. 8 is a perspective diagram illustrating the shed housing 100 with a closed opening mounted on the shed 10 according to Embodiment One of the present disclosure.
Figure 9:
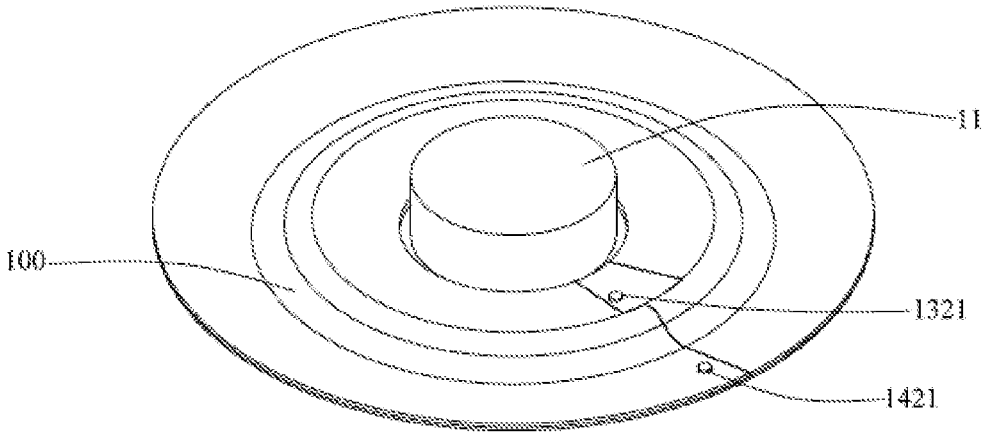
FIG. 9 is a bottom view of the shed housing 100 with the closed opening mounted on the shed 10 according to Embodiment One of the present disclosure.

As shown in FIG. 8 and FIG. 9, when the first connecting portion 130 and the second connecting portion 140 are joined together, the shed housing 100 has continuous transition at the joining. The joining has a same thickness as other portions of the shed housing 100. The protrusion 1311, the protrusion 1321 and the protrusion 1421 slightly protrude from the surface of the shed housing 100 relative to the corresponding through holes.

In this embodiment, the connection structure is integrated with the shed housing 100, so that the shed housing 100 may be sleeved on the shed 10 and joined in the circumferential direction without any additional connection structure. There is no need to make model to produce additional connecting components, so it is simple for manufacturing and processing, with a lower cost. When the protrusion is fitted into the through hole, the protrusion extends slightly out of the through hole relative to the surface of the shed housing. In this way, the protrusion may resist tension at the opening to a certain extent, and withstand the through hole in the horizontal direction to ensure the reliability of the connection between protrusion and through hole. The extended portion 180 may further increase the creepage distance of the insulator. In order to meet the actual needs, the protrusion may also be substantially flush with the surface of the shed housing. The first connecting portion and the second connecting portion may be joined together by overlapping the first connecting portion and the second connecting portion to a certain extent, and the joining has a thickness slightly different from other portions of the shed housing.

Embodiment Two

Figure 10:
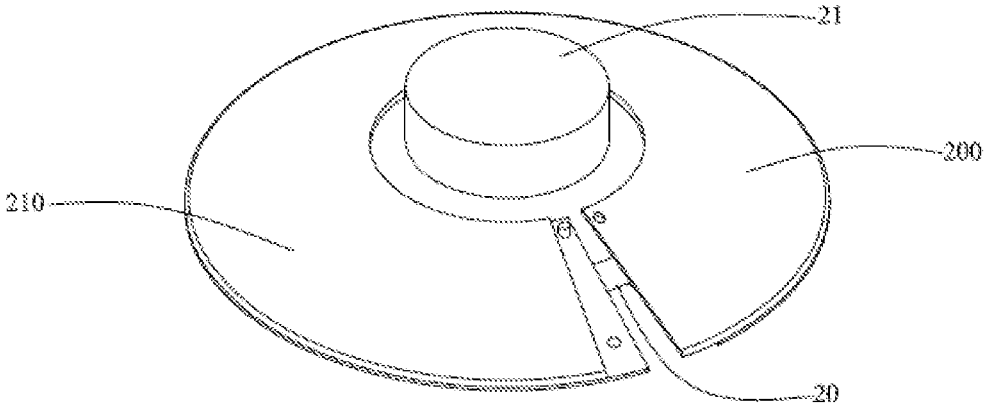
FIG. 10 is a perspective diagram illustrating a shed housing 200 with an unclosed opening mounted on the shed 20 according to Embodiment Two of the present disclosure.
Figure 11:
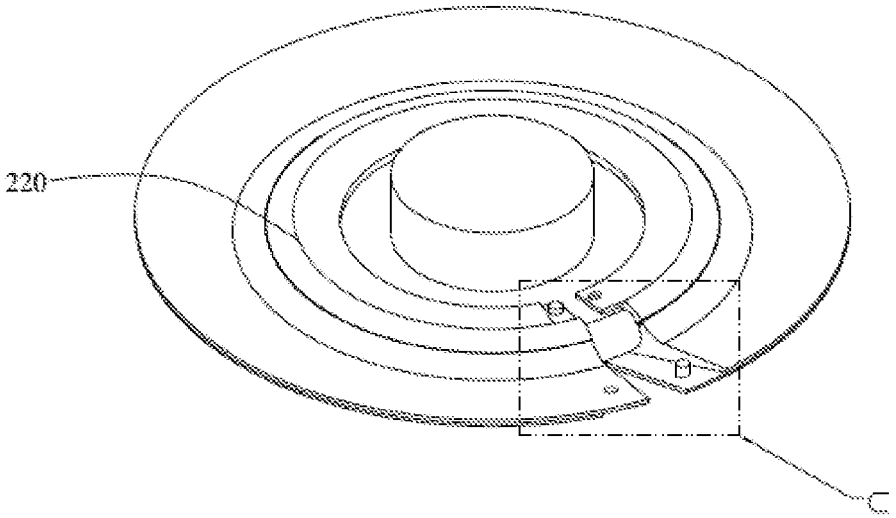
FIG. 11 is a bottom view of the shed housing 200 with the unclosed opening mounted on the shed 20 according to Embodiment Two of the present disclosure.
Figure 12:
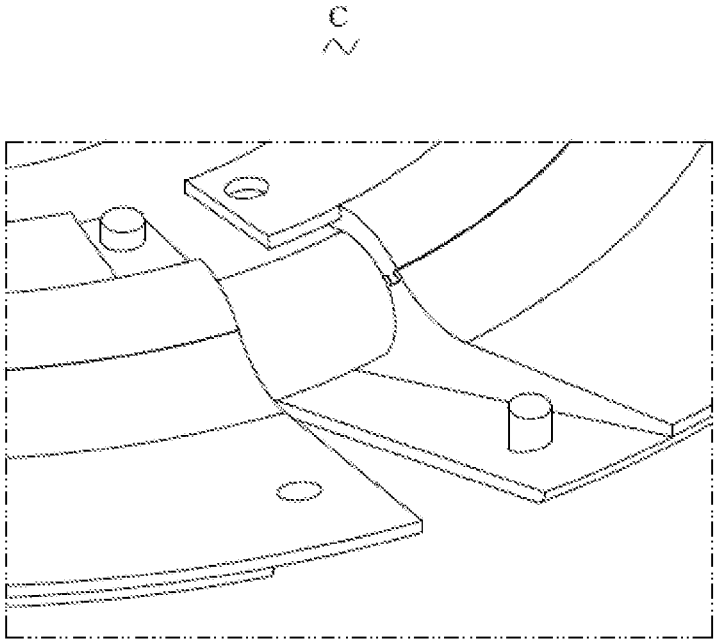
FIG. 12 is an enlarged view of a portion C of the shed housing 200 with the unclosed opening mounted on the shed 20 according to Embodiment Two of the present disclosure.

As shown in FIGS. 10-12, the shed housing 200 in this embodiment has substantially the same configuration as the shed housing 100 in Embodiment One, except that neither the upper shed housing body 210 nor the lower shed housing body 220 of the shed housing 200 completely covers on the upper surface and the lower surface of the shed 20, and the upper shed housing body 210 and the lower shed housing body 220 are separately provided and should be joined to form a receiving cavity for covering the shed 20. Specifically, a distance from the mounting hole of the shed housing 200 to a boundary between the insulating core 21 and the shed 20 along the surface of the shed 20 is one-third of a distance from the insulating core 21 to the tip of the shed 20 along the surface of the shed 20.

Figure 13:
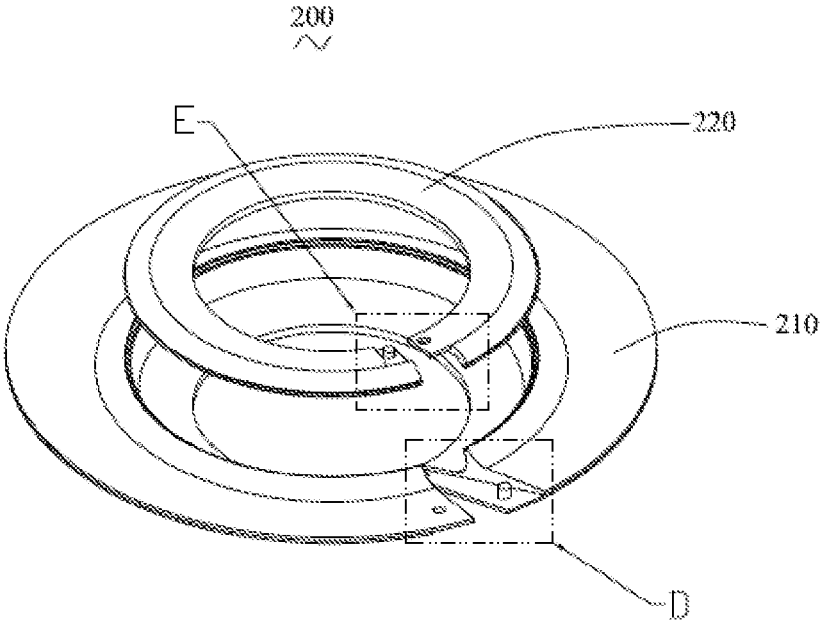
FIG. 13 is an exploded view of an upper shed housing body 210 and a lower shed housing body 220 according to Embodiment Two of the present disclosure.
Figure 14:
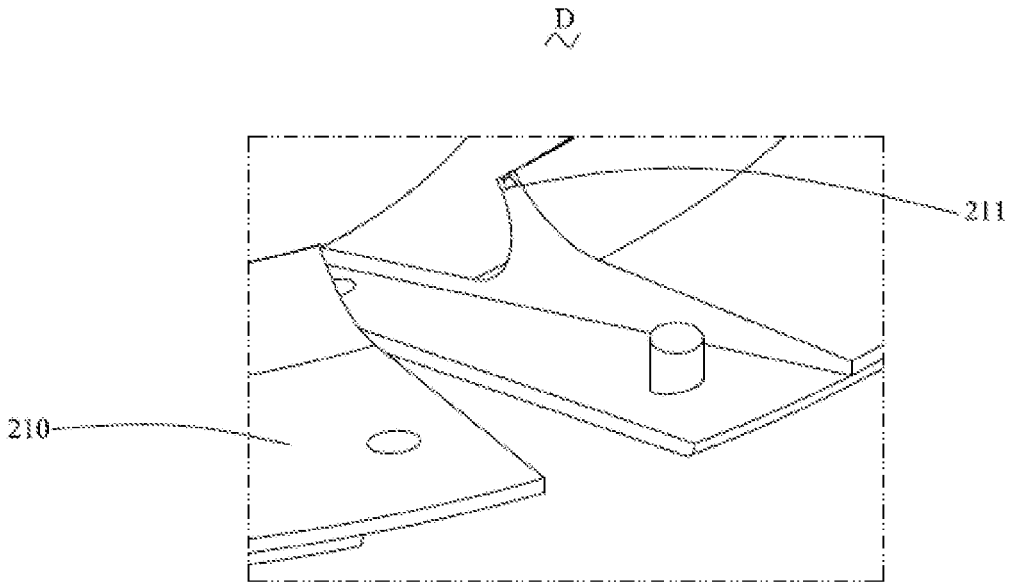
FIG. 14 is an enlarged view of a portion D of the upper shed housing body 210 according to Embodiment Two of the present disclosure.
Figure 15:
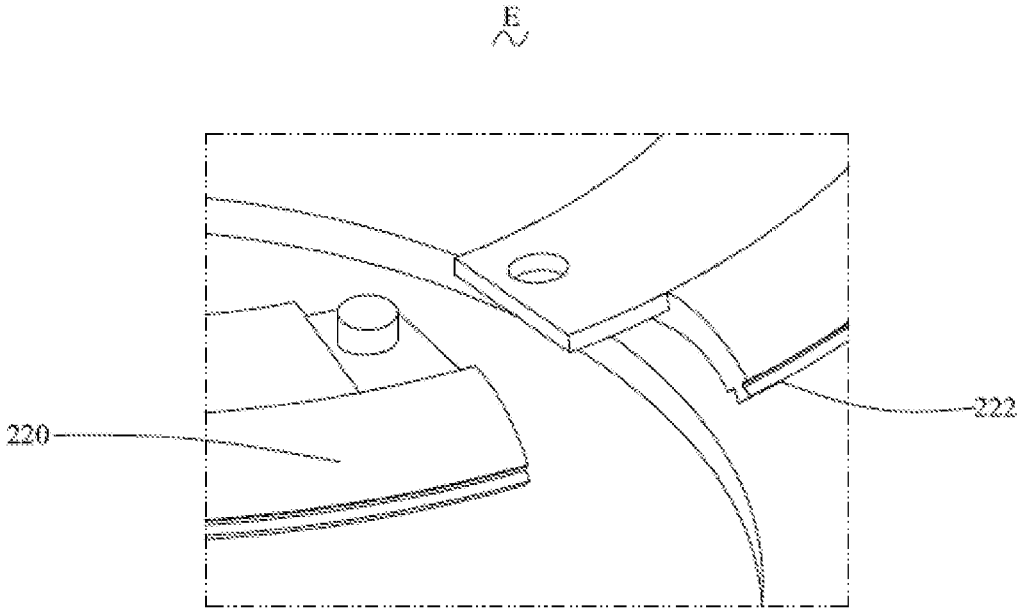
FIG. 15 is an enlarged view of a portion E of the lower shed housing body 220 according to Embodiment Two of the present disclosure.
Figure 16:
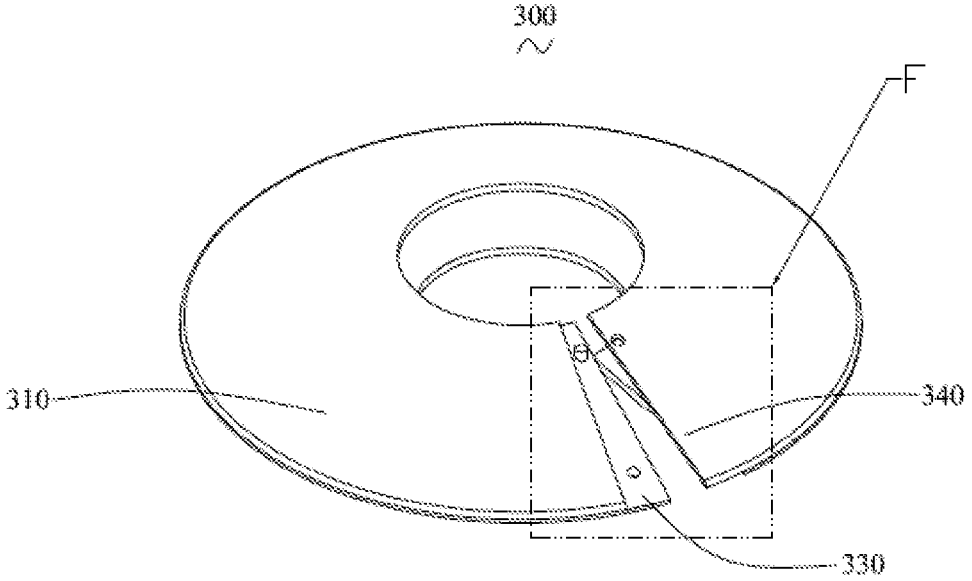
FIG. 16 is a perspective diagram illustrating a shed housing 300 according to Embodiment Three of the present disclosure.
Figure 17:
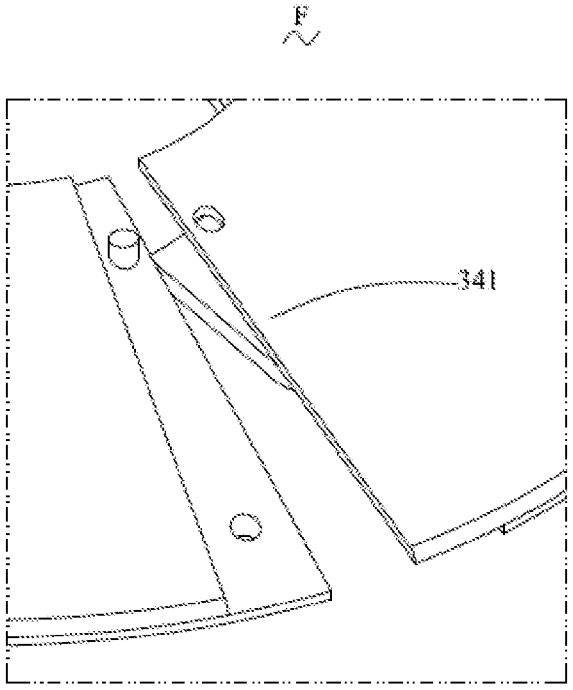
FIG. 17 is an enlarged view of a portion F of the shed housing 300 according to Embodiment Three of the present disclosure.
Figure 18:
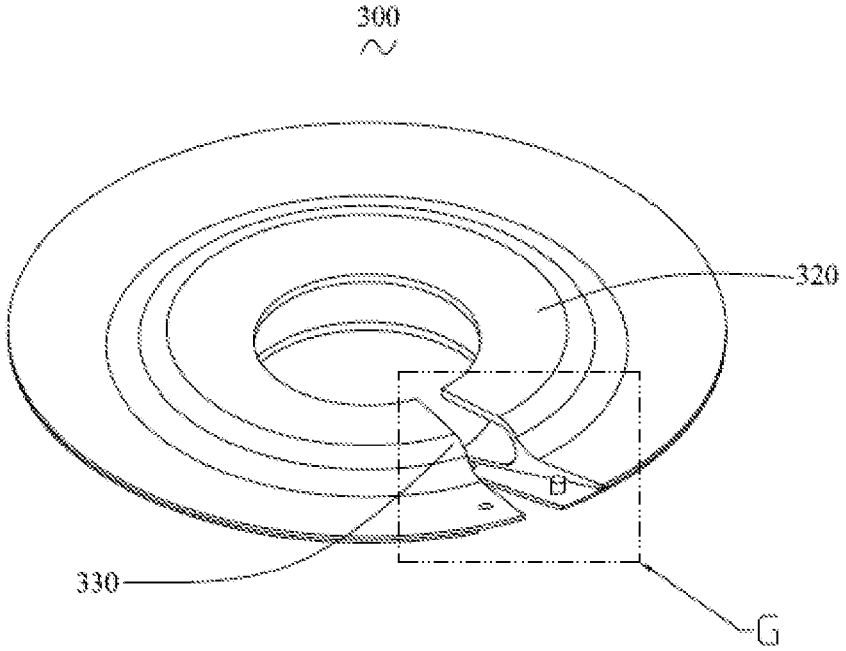
FIG. 18 is a top view of the shed housing 300 according to Embodiment Three of the present disclosure.
Figure 19:
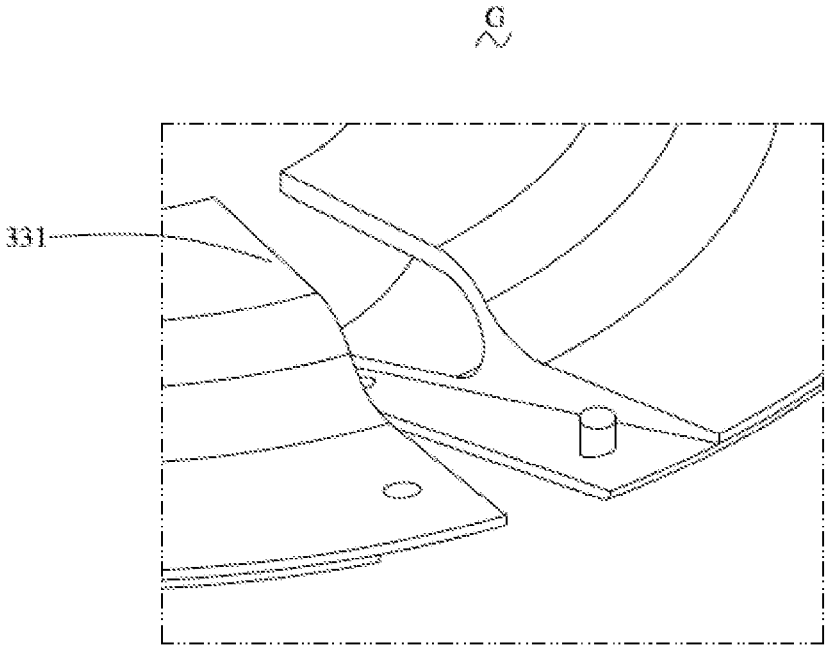
FIG. 19 is an enlarged view of a portion G of the shed housing 300 according to Embodiment Three of the present disclosure.
Figure 20:
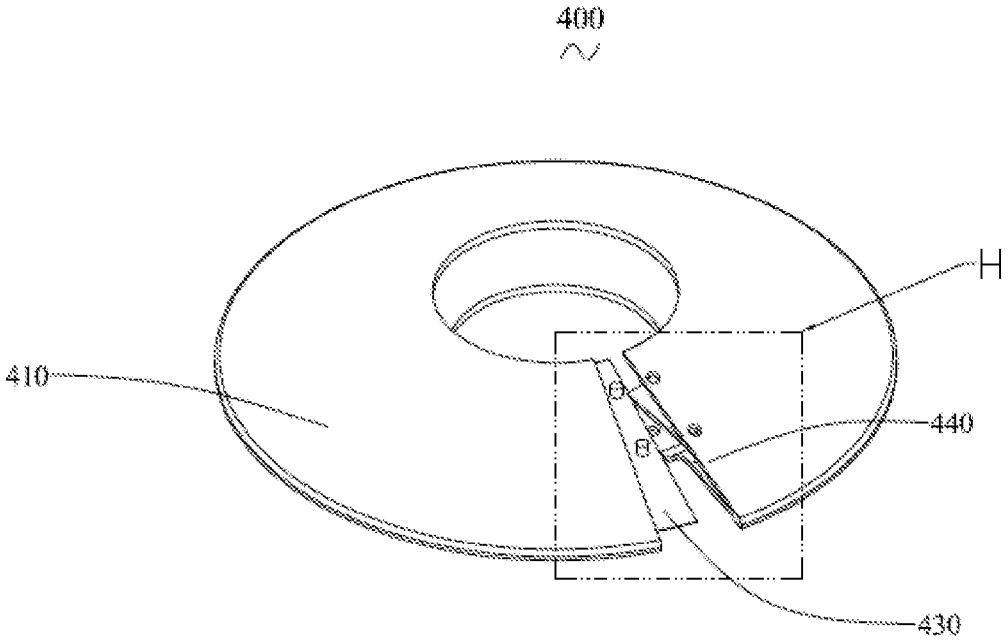
FIG. 20 is a perspective view of a shed housing 400 according to Embodiment Four of the present disclosure.
Figure 21:
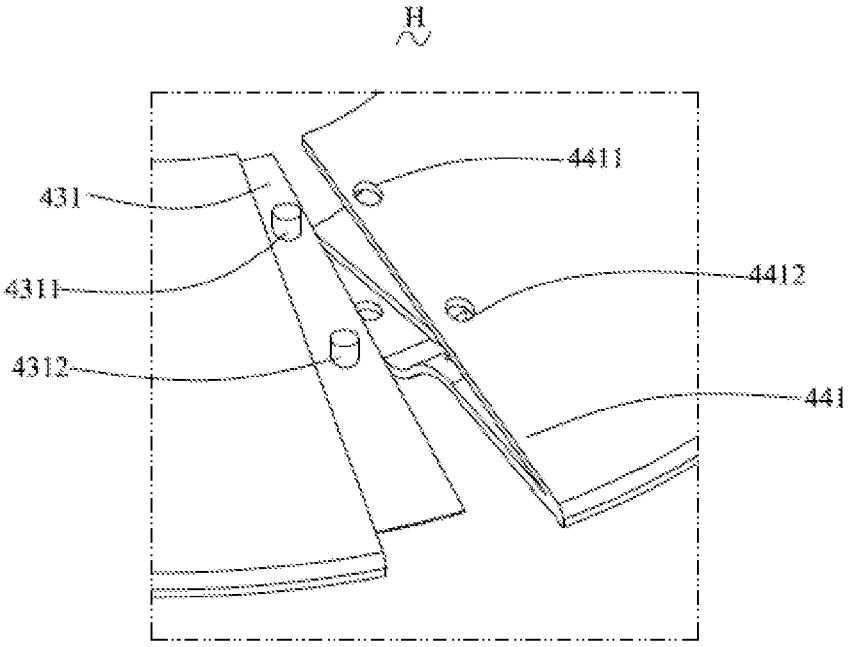
FIG. 21 is an enlarged view of a portion H of the shed housing 400 according to Embodiment Four of the present disclosure.
Figure 22:
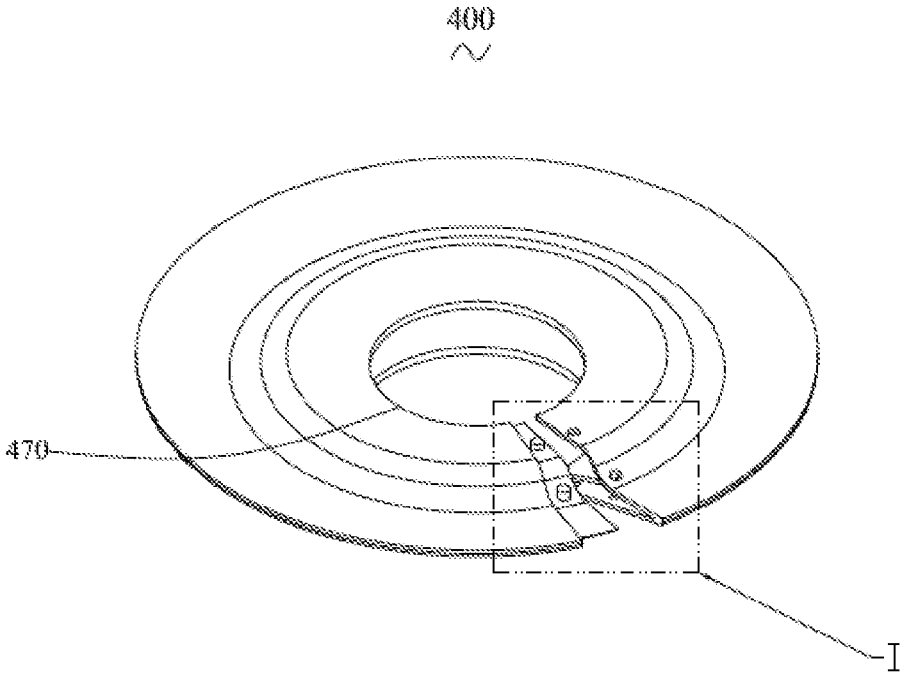
FIG. 22 is a bottom view of the shed housing 400 according to Embodiment Four of the present disclosure.
Figure 23:
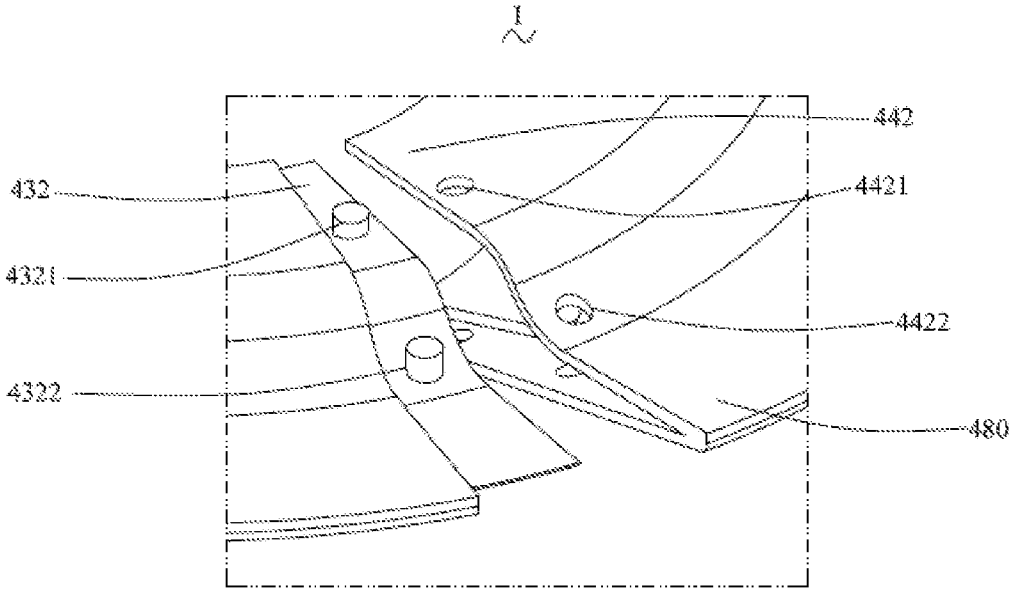
FIG. 23 is an enlarged schematic view of a portion I of the shed housing 400 according to Embodiment Four of the present disclosure.

As shown in FIGS. 13-15, in this embodiment, the upper shed housing body 210 and the lower shed housing body 220 are joined together to form a receiving cavity through a connecting structure in a form of a dovetail groove. A concave dovetail groove 211 is provided on the lower surface of the upper shed housing body 210 around the insulating core 21, and configured to be connected to lower shed housing body 220. The lower shed housing body 220 is annular-shaped, and a hole through which the insulating core 21 passes is provided in the middle of the lower shed housing body 220. A protrusion 222 corresponding to the concave dovetail groove 211 is provided on an outer edge of the lower shed housing body 220. The protrusion 222 is arranged in a circumferential direction around the insulating core 21. The protrusion 222 is able to be joined with the concave dovetail groove 211 to form a receiving cavity for receiving the shed 20. Of course, the upper shed housing body 210 and the lower shed housing body 220 may be joined together in other manners, such as buckle and lock.

In this embodiment, the manufacturing and processing of the shed housing 200 may be further simplified by converting a complex configuration into a way of joining the upper shed housing body 210 and the lower shed housing body 220, to reduce the manufacturing cost. The shed housing 200 do not cover the upper surface and the lower surface of the shed 20 completely, so that the material consumption and the cost can be reduced, meanwhile the effect on preventing pollution flashover and rain flashover can be achieved.

Embodiment Three

As shown in FIGS. 16-19, the shed housing 300 in this embodiment has substantially the same structure as the shed housing 100 in Embodiment One, with a difference that the first connecting portion 330 and the second connecting portion 340 are different from the first connecting portion 130 and the second connecting portion 140 in the shed housing 100.

Portions of the first connecting portion 330 and the second connecting portion 340 located on the upper shed housing body 310 are the same as those on the shed housing 100. A strap 331 is provided on a portion of the first connecting portion 330 located on the lower shed housing body 320 and is formed by extending the lower shed housing body 320 around the insulating core in a circumferential direction of the shed housing 300. There is no connecting portion provided on a portion of the second connecting portion 340 located on the lower shed housing body 320. That is, the first connecting portion 330 and the second connecting portion 340 are formed by joining the strap 331 provided on a portion of the first connecting portion 330 located on the lower shed housing body 320 and a strap 341 provided on a portion of the second connecting portion 340 located on the upper shed housing body 310.

For the shed housing 300 in this embodiment, the portion of the first connecting portion 330 located on the lower shed housing body 320 and the portion of the second connecting portion 340 located on the lower shed housing body 320 may be joined together by joining the straps directly. In this way, the manufacturing and processing of the connecting portions of the shed housing 300 can be further simplified, and the manufacturing cost can be reduced.

Embodiment Four

As shown in FIGS. 20-23, the shed housing 400 in this embodiment has substantially the same structure as the shed housing 100 in Embodiment One, with a different that the first connecting portion 430 and the second connecting portion 440 are different from the first connecting portion 130 and the second connecting portion 140 in the shed housing 100.

A groove 431 is provided in a portion of the first connecting portion 430 located on the upper shed housing body 410. The length of the groove 431 extending along a radial direction of the shed housing 400 is less than the length of the shed housing 400. A strap 441 cooperating with the groove 431 is provided on a portion of the second connecting portion 440 located on the upper shed housing body 410, and the strap 441 has a same structure as the strap 141 of the shed housing 100. A groove 432 is provided on a portion of the first connecting portion 430 located on the lower shed housing body 420. The groove 432 extends along the radial direction of the shed housing 400 to the extended portion 480. The length of the groove 432 extending along the radial direction of the shed housing 400 is less than the length of the shed housing 400. A strap 442 cooperating with the groove 432 is provided on a portion of the second connecting portion 440 located on the lower shed housing body 420. The strap 441 extends along the radial direction of the shed housing 400 to an outer edge of the extended portion 480. That is, the second connecting portion 440 formed by the strap 441 and the strap 442 and the first connecting portion 430 formed by the groove 431 and the groove 432 are closed at the outer edge of the shed housing 400, and respectively form V-shaped connecting portions with an opening along the radial direction of the shed housing 400 at the mounting hole 470 of the shed housing. The first connecting portion 430 and the second connecting portion 440 are embedded and connected to each other along a latitudinal direction of the shed housing 400, so that the shed housing 400 is closed in the circumferential direction.

In this embodiment, the protrusion 4311 and the protrusion 4312 are arranged on the groove 431 in the radial direction of the shed housing 400. The through hole 4411 corresponding to the protrusion 4311 and the through hole 4412 corresponding to the protrusion 4312 are arranged on the strap 441. The protrusion 4321 and the protrusion 4322 are arranged on the groove 432 in the radial direction of the shed housing 400. The through hole 4321 corresponding to the protrusion 4321 and the through hole 4322 corresponding to the protrusion 4322 are provided on the strap 442.

In this embodiment, the amount of pairs of the protrusion and the through hole on the groove 431, the strap 441, the groove 432, and the strap 442 may be adjusted according to actual needs. The protrusions are provided on the grooves, and the through holes are provided on the straps, so that protrusions can protrude outward from the shed housing naturally during connecting, to avoid contacting the shed and affecting the connection effect of the shed housing. The double V-shaped connection structure can increase the area of the connecting portions of the shed housing, to make the connection firmer.

Embodiment Five

Figure 24:
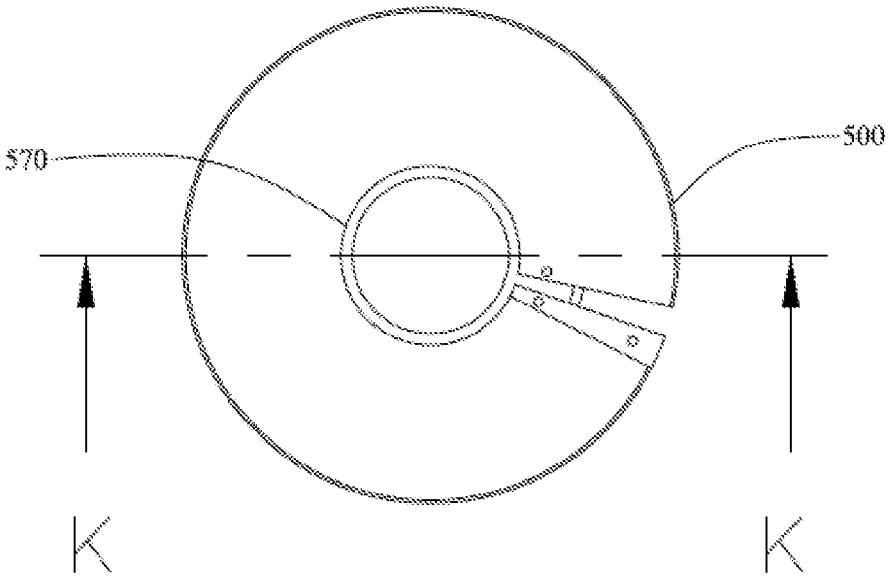
FIG. 24 is a top view of the shed housing 500 with an unclosed opening mounted on a shed 50 according to Embodiment Five of the present disclosure.
Figure 25:
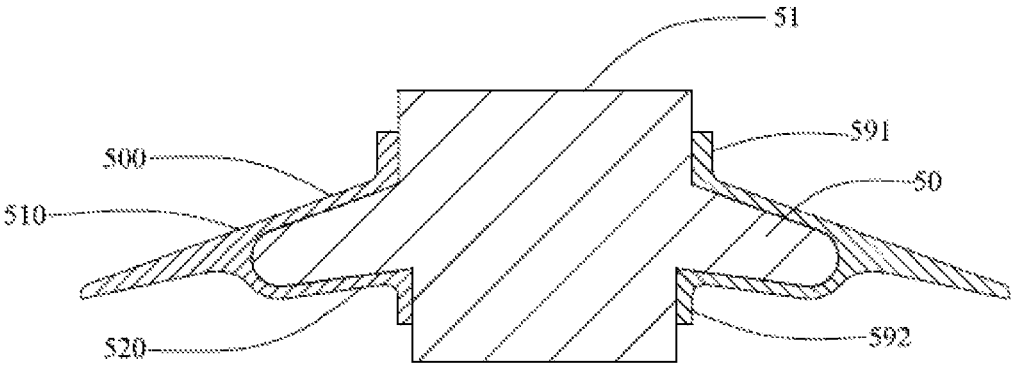
FIG. 25 is a schematic diagram illustrating a cross section of the shed housing 500 with the unclosed opening mounted on the shed 50 along a K-K plane according to Embodiment Five of the present disclosure.

As shown in FIGS. 24-25, the shed housing 500 of in this embodiment has substantially the same structure as the shed housing 100 in Embodiment One, except that a sleeve 591 and a sleeve 592 are provided on the shed housing 500 at the mounting hole 570. The sleeve 591 and the sleeve 592 extend away from the surface of the shed housing 500 along an axial direction of the insulating core 51. Inner diameters of the sleeve 591 and the sleeve 592 fit an outer diameter of the insulating core 51, inner walls of the sleeve 591 and the sleeve 592 fit an outer wall of the insulating core 51 closely. The sleeve 591 extends upward away from the upper surface of the upper shed housing body 510 along the axial direction of the insulating core 51. The sleeve 592 extends downward away from the lower surface of the lower shed housing body 520 along the axial direction of the insulating core 51.

In this embodiment, the shed housing 500 is provided with sleeves covering the outer wall of the insulating core. These sleeves are connected to the insulating core tightly to strengthen the strength of the connection between the shed housing and the insulating core, to further ensure the tightness and reliability of the shed being covered by the shed housing. The diameter and height of each sleeve can be designed according to the actual situation. The shed housing can also be provided with only one sleeve or without sleeve.

Although the present disclosure and its technical features have been described as above, it should be understood that there are numerous modifications of the illustrated embodiments described above which will be readily apparent to one skilled in the art, such as many variations and modifications in the above configurations and materials, including combinations of features disclosed herein that are individually disclosed or claimed herein, explicitly including additional combinations of such features. These modifications and/or combinations fall within the technical field of the present disclosure and fall into the scope of the appended claims.

What is claimed is:

1. A shed housing for covering an insulator including at least one shed, comprising a receiving cavity to allow an upper surface and a lower surface of the shed to be received in the receiving cavity, wherein the shed housing comprises an upper shed housing body and a lower shed housing body, a concave dovetail groove is provided on the lower surface of the upper shed housing body, a protrusion corresponding to the concave dovetail groove is provided on an outer edge of the lower shed housing body, through joining the protrusion with the concave dovetail groove, the upper shed housing body is joined with the lower shed housing body to form the receiving cavity, wherein the shed housing is provided with a mounting hole through which the insulator passes, and an opening corresponding to the mounting hole, the opening communicates the mounting hole with an outer edge of the shed housing, the mounting hole communicates with the receiving cavity, a first connecting portion and a second connecting portion cooperating with each other are arranged respectively on both ends of the opening, and when the first connecting portion is connected to the second connecting portion, the shed housing is closed along a circumferential direction, wherein a first groove is provided on a portion of the first connecting portion located on the upper shed housing body, and a first strap is provided on a portion of the second connecting portion located on the upper shed housing body, wherein the first groove is provided with at least one first protrusion and the first strap is provided with at least one first through hole fitting the at least one first protrusion, and wherein the first protrusion cooperates with the first through hole to connect the first strap with the first groove and close the shed housing along a circumferential direction.

2. The shed housing of claim 1, wherein a second groove is provided on a portion of the first connecting portion located on the lower shed housing body, and a second strap is provided on a portion of the second connecting portion located on the lower shed housing body, wherein the second strap cooperates with the second groove to close the lower shed housing body along a circumferential direction.

3. The shed housing of claim 2, wherein when the first groove is connected to the first strap, an upper surface of the second connecting portion is flush with a surface of the upper shed housing body, and when the second groove is connected to the second strap, a lower surface of the second connecting portion is flush with a surface of the lower shed housing body.

4. The shed housing of claim 2, wherein the second groove is provided with at least one second protrusion, and the second strap is provided with at least one second through hole fitting the second protrusion.

5. The shed housing of claim 1, wherein the shed housing includes an extended portion extending outward from a tip of the shed, and the first connecting portion and the second connecting portion extend along an upper surface of the extended portion.

6. The shed housing of claim 1, wherein the insulator includes an insulating core, and a distance from an edge of the mounting hole to the tip of the shed along a surface of the shed is smaller than a distance from the tip of the shed to a junction between the insulating core and the surface of the shed along the surface of the shed.

7. The shed housing of claim 6, wherein a distance from the edge of the mounting hole of the shed housing to the junction between the insulating core and the surface of the shed along the surface of the shed is one-third of a distance from the insulating core to the tip of the shed along the surface of the shed.

* * * * *